United States Patent [19]

Burns

[11] 4,114,925

[45] Sep. 19, 1978

[54] HOLDER DEVICE

[76] Inventor: Howard Mathew Burns, 344 E. Hardin, Apt. 8, Findlay, Ohio 45840

[21] Appl. No.: 808,810

[22] Filed: Jun. 22, 1977

[51] Int. Cl.[2] ..... B42D 17/00

[52] U.S. Cl. ..... 281/45; 40/10 R; 40/360

[58] Field of Search ..... 281/45; 40/10, 360

[56] References Cited

U.S. PATENT DOCUMENTS

| | | | |
|---|---|---|---|
| 956,534 | 5/1910 | Lahey | 281/45 |
| 2,636,751 | 4/1953 | Carlson | 281/45 |
| 2,658,773 | 11/1953 | Tarris | 281/45 |

*Primary Examiner*—Willie G. Abercrombie
*Attorney, Agent, or Firm*—Paul F. Stutz

[57] ABSTRACT

A one-piece holder for a golf score card and pencil or the like, said device comprising a generally elongate planar member having two depending legs and a central deflectable but connected finger formed by a U-shaped cut, said finger being deflected slightly upward to receive said score card and including a distorted region accommodative of a pencil, said legs including means for attachment to a golf bag collar strap, means for avoiding damage to the bag and means for reliable anchoring of the member in one position.

10 Claims, 3 Drawing Figures

HOLDER DEVICE

The present invention relates to a convenience accessory for the sport of golf. The sport or game of golf is well understood and need not be described, excepting to say that it is well known that the golfer transports his clubs almost universally in a golf bag which is carried over the shoulder or mounted in a two-wheeled pull cart or suitably located on a mobile four-wheeled cart provided with electric battery or gasoline engine propulsion and suitable seats for passengers.

There are a wide variety of accessories that are known and/or marketed and are desirably employed by the golfer to improve or simplify his game or which otherwise contribute to orderly play, to carefree play or to convenience in the play of the game. For example, golf tee holders of particular design are disclosed in U.S. Pat. No. 1,739,780. Additionally, most golf bags include side mounted pockets to store therein golf balls, tees, pencils and the like and are provided with access zippers or buttons. These are shown in dotted outline in U.S. Pat. No. 3,010,628. The latter patent also discloses a golfer's case adapted to receive and carry in convenient fashion a variety of articles from pencils to tees and even a pocket for a score card. U.S. Pat. Nos. 2,658,773 and 2,802,250 also disclose different types of golf score card holders.

The device shown in U.S. Pat. No. 3,010,628 is unfortunately simply clipped to the upper circular edge of the golf bag and is accordingly rather unreliable, insecure and the device is otherwise quite complicated, bulky, cumbersome, expensive and otherwise unattractive. The device shown in U.S. Pat. No. 2,802,250 likewise simply hooks onto the top of the circular edge of the golf bag and accordingly is insecurely held, subject to loss and is otherwise defective and undependable in that the pencil holder is rigid and limited to one specific diameter of pencil. The device shown in U.S. Pat. No. 2,658,773 is clearly bulky, complicated in structure and likewise insecure in the clip hook attachment to the golf bag.

With the foregoing introduction, it is a general object of the present invention to provide a convenient golfing accessory device for conveniently carrying a pencil and score card in secure fashion and accessible location on the ever present golf bag and therefore most desirable and useful to the golfer.

It is a particular object of the present invention to provide a device which is of simple one-piece, and therefore reliable, construction and includes means for reliable securement to the golf bag and means adapted to hold a variety of sizes of pencils.

It is another object of the present invention to provide a device which overcomes the shortcomings in structure, design and functional usefulness of the accessories known heretofore.

It is yet another object of the present invention to provide a device which is so extremely simple of design that it permits manufacture at a very low cost and yet, by reason of its interdependent features of construction and design, provides a secure and reliable holding of two items, namely, pencils of varying size and the score card, both of which are essential to satisfactory play.

The foregoing as well as other objects of the present invention will become apparent to those skilled in the art from the following detailed description taken in conjunction with the annexed sheet of drawings on which there are presented, for purpose of illustration only, preferred embodiments of the present invention.

IN THE DRAWINGS

Figure 1:
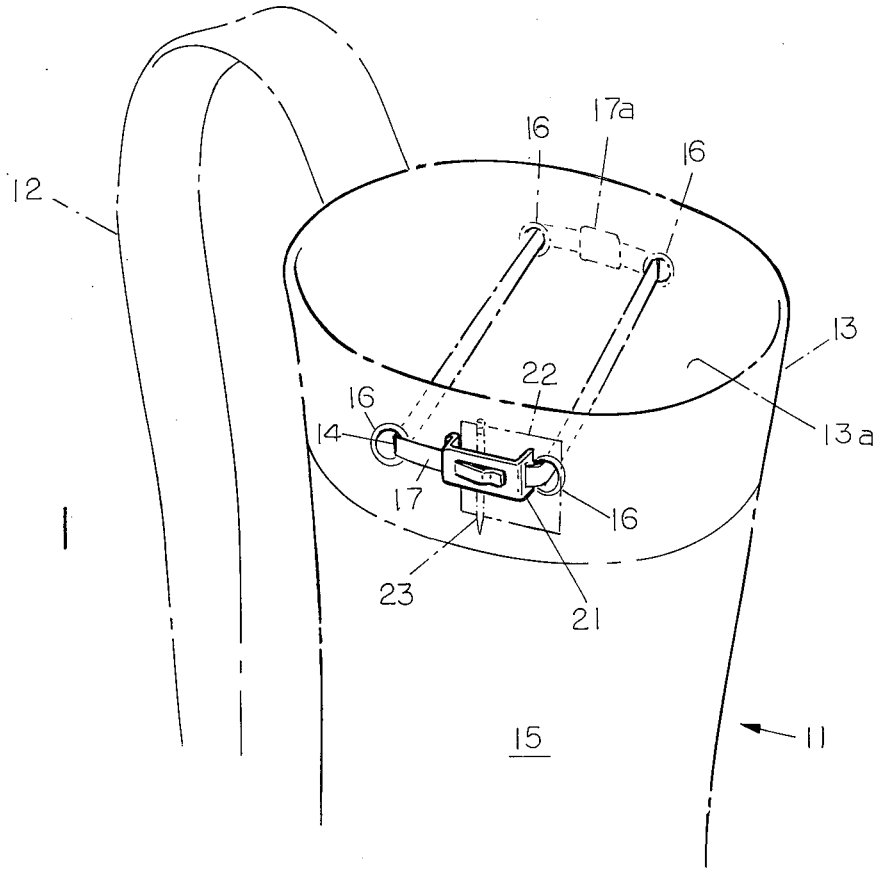
FIG. 1 is a three-quarter perspective view of the holder device of the present invention shown carried on a golf bag, with the major portions of the bag in dotted outline.

Referring now more specifically to the drawings, there is disclosed in FIG. 1, in dotted outline, a golf bag 11 having a connected looped shoulder strap 12 and an upper collar 13 surrounding the upwardly opening mouth 13a from which clubs project, although not shown. The collar 13 conventionally is formed of folded over material of the material of which the bag is made, of leather or simulated leather or plastic. The collar defines a space 14 between it and the normal cylindrical body surface 15. The collar generally features a plurality of spaced eyelets, usually four, such as identified by the reference numeral 16, which permits a strap 17 to be entrained therethrough, both for decorative appeal and also to provide functional utility. The strap 17 is laced through the four eyelets 16 from the outside of the bag and passing across the mouth or upper opening of the bag twice as shown, thereby dividing the mouth of the bag into three separate compartments to allow separation of the different golf clubs according to the desire of the golfer. Usually, the woods are separated from the irons and usually even the irons are divided into separate groupings to provide convenience to the golfer in selecting the desired club and in replacing the club in the desired compartment.

In accordance with the present invention (see FIG. 2), the carrier or holder device 21 of the present invention is shown carried by the strap 17 and with a score card 22 and a pencil 23 mounted thereon and in a manner more particularly described hereinafter. The score card and pencil are both shown in dotted outline so as not to obscure the device.

Figure 2:
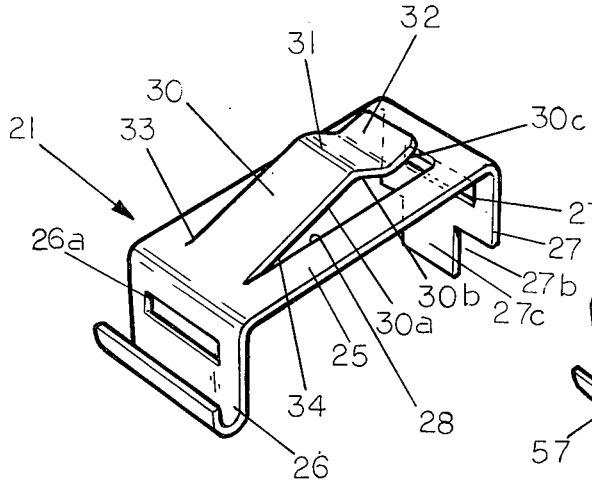
FIG. 2 is a three-quarter perspective view of the accessory holder device detached from the golf bag in order to show the interrelated features of structure and design.

In FIG. 2, the device 21, desirably formed of a relatively thin gauge spring-like metal or plastic, includes an elongate principal panel 25 and connected legs 26 and 27; the legs being in spaced parallel relationship and integrally connected at the opposite end of the panel 25. A generally U-shaped cut 28 through the panel defines a connected but deflectable central portion 30. The portion 30 is deformed upwardly as at 31 and the terminal edge is bent upwardly as at 32. The upwardly deflected central portion defines juncture regions or slots 33 and 34 where joinder with the central panel 25 occurs; which spaced slots exert a frictional clasping action upon score cards of varying thicknesses. The upwardly terminal edge 32 allows the finger of the user to move the central portion 30 upward as needed to locate a pencil underneath the deformed region 31. The upturned terminal edge 32 of the central portion also allows the score card to be easily inserted between the central portion and the surrounding upper surface of the central panel 25.

The pencil 23 will be inserted and removed from the clip by force. Pressing outwardly with the pencil against the surface **30*b* will cause the finger 30 to spread away from the panel 25, allowing the pencil to be removed. Pressing the pencil inwardly against the surface 30***c* will again cause the finger 30 to bend backwardly, allowing the pencil to be inserted.

The opposing downwardly angling surfaces 30*a* and 30*b* in relation to panel 25 in conjunction with the spring-like force of finger 30 toward panel 25 will cause the pencil 23 to be held securely in place beneath the concave juncture of surfaces 30*a* and 30*b* as referenced at 31. Such spring-like force will exist because the diameter of the pencil will be greater than the distance between the interior of the concave juncture of surfaces 30*a* and 30*b* and panel 25 when the pencil is not within the confines of the clip.

The features of construction as just described accommodate considerable variance in the size and thickness of the score card and the size and particularly the diameter of the pencil.

The legs 26 and 27 are each possessed of corresponding transverse slots 26*a* and 27*a* through which the strap 17 can be threaded. Usually, of course, the strap 17 proceeding as described in the collar region 13 of the bag and through the eyelets has a buckle arrangement 17*a* which permits its unfastening and partial unthreading through the eyelets such that the belt can be threaded through the slots 26*a* and 27*a* and thence returned to the slots and then rebuckled so that the device would be securely carried on the bag, rather than simply clipped or hooked.

The terminal edge of leg 26 is bent reversely upwardly so that it will not abradingly contact the surface of the collar region as would otherwise tend to injure or even puncture it, whether formed of leather, plastic, nylon or any of the sheet-like materials normally used in the fabrication of the golf bag. The leg 27 is cut away as at 27*b* to define a narrowed region 27*c* sized in width to accordingly be readily receptive in the eyelet 16 and thus preclude movement of the device 21 along the lateral or circular extent of the strap but rather held in a reliably secure position known to the user for convenient access at each time needed for recording the strokes of the player or those in his party.

As indicated, desirably the holder device 21 is formed of one piece to lend structural integrity. If formed of metal, the device would be initially formed of a relatively thin gauge metal having spring-like characteristics. Slots 26*a* and 27*a* would be punched out in an initial die cutting operation, possibly in conjunction with the formation of the cut 28 forming central portion 30 and the narrowed leg configuration 27*c*. The thusly slotted and cut piece would then be located in a female cavity of a suitable stamping die and thence formed into the configuration shown in FIG. 2.

If formed of plastic, the device can be molded, either by means of compression or injection molding, to yield the integral one-piece structure. Various plastics can be employed to form the device as shown. A plural cavity mold would enable large numbers of the devices to be molded at a given time. The selected plastic, of course, should possess the desirable combination of properties of hardness, toughness and resilience as to permit repeated flexing of the portion 30 as accommodative of insertion and removal of the score card and pencil a large number of times.

Figure 3:
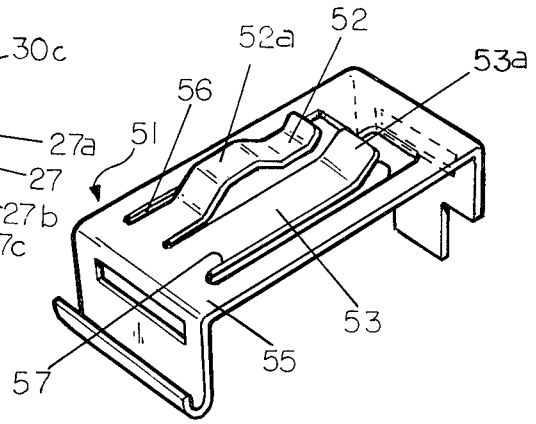
FIG. 3 is a view like FIG. 2 but showing a variant embodiment of the present invention.

In the embodiment of FIG. 3, the device identified by the reference numeral 51 is essentially similar to the embodiment of FIG. 2, excepting that in place of one portion 30, the device incudes two fingers 52 and 53; each formed by an appropriate cut extending through the thickness of the central panel portion 55, with the fingers otherwise distorted at their end extremity to angle slightly upwardly and with the finger 52 distorted as at 52*a* shown to accommodate the pencil. In this embodiment, the user would simply slide the golf score card from the right, past the conveniently upturned end extremity 53*a* and at the same time under the finger 52 such that the edge of the score card would be securely grapsed by slot regions 56 and 57. The retention of the score card by the finger 53 would also be assisted in this embodiment by the retention or location of the pencil underneath the region 52*a* of the pencil finger, since the pencil proceeding transversely of the device 51 would be translating the downward pressure of finger 52 through the pencil down onto the finger 53 which would be urged downwardly, enhancing the holdment or physical contact between the finger 53 and the score card and ensuring the reliability of the retention or the holding of the score card. The player simply then at appropriate time would remove the pencil, which would tend to release or reduce the downward pressure on the finger 53 holding the score card, allowing it to then be easily removed.

A desirable feature of the present invention is that the device is relatively small and obscure. Consequently, it does not dominate in size or appearance as in the case of some larger and more cumbersome accessory devices known in the art; certain of which are described hereinabove. As a matter of fact, with the score card and the pencil located in their respective held positions, the device 21 itself is practically hidden from view as is most clearly evident from the showing in FIG. 1.

It can thus be seen that the device is singularly functional in character, embodies extreme simplicity of design and construction and accordingly the latter is reflected in low cost of manufacture and, of course, relatively low cost to the user or consumer. It is envisioned that the device of the present invention if formed of metal would be desirably treated to provide resistance and hopefully imperviousness to oxidative rust. Although the treatment is not a part of the present invention, it is known in the art to use a chemical bluing-type material applied as a liquid, or in which the metal would be dipped, to enhance the resistance against rusting. If aluminum would be elected as the material of construction, of course, surface treatment such as anodizing and the like are known to enhance the resistance against oxidative effects. Of course, if plastic is to be the material of construction, the oxidation and rust are not significant problems. In certain applications, a plastic selected for its transparency may enhance the use of the device and its attractiveness and acceptance.

Obvious modifications of the disclosed device may be made and are to be included within the scope of the present invention unless such would do violence to the language of the appended claims.

I claim:

1. A carrier for a pencil and score card or the like adapted for releasable attachment to a golf club bag and particularly to the upper collar region thereof, said collar including a plurality of eyelets and a peripheral strap extending through said eyelets, said carrier comprising a one-piece member composed of a principal generally rectangular panel, said panel including a deflectable central portion defined by a generally U-shaped cut extending through said principal panel, said central portion being deflected slightly upwards from the plane of said panel to define a card-retaining means at the juncture of said central portion with said panel and having a transverse upwardly distorted region spaced from the terminal edge of said central portion to compressingly accommodate a pencil beneath it and the surrounding panel, and means integral with said carrier for releasable securement to said elongate strap.

2. The invention as claimed in claim 1, wherein said means includes a pair of legs generally normally disposed to and located at the opposite ends of said principal panel, said legs each including a transverse slot adapted to receive said elongate strap.

3. The invention as claimed in claim 2, wherein one leg has a lower terminal end bent reversely to avoid edge contact with the underlying golf bag surface.

4. The invention as claimed in claim 3, wherein the other leg has a narrowed terminal end adapted for reception by one of said eyelets.

5. The invention as claimed in claim 4, wherein said terminal edge of said central portion is bent slightly upwards to facilitate card insertion.

6. The invention as claimed in claim 1, wherein said panel includes two deflectable, generally centrally located fingers defined by appropriate cuts through said central panel, said fingers lying side by side, one of said fingers being adapted to receive and frictionally embrace a score card and the other finger having an upwardly distorted region adapted to receive and compressingly retain a pencil.

7. The invention as claimed in claim 6, wherein said card-retaining finger has an upwardly bent terminal edge to facilitate card insertion.

8. The invention as claimed in claim 6, wherein said means includes a pair of legs generally normally disposed to and located at the opposite ends of said principal panel, said legs each including a transverse slot adapted to receive said elongate strap.

9. The invention as claimed in claim 8, wherein one leg has a lower terminal end bent reversely to avoid edge contact with the underlying golf bag surface.

10. The invention as claimed in claim 9, wherein the other leg has a narrowed terminal end adapted for reception by one of said eyelets.

* * * * *